United States Patent [19]

Parker

[11] Patent Number: 4,605,143

[45] Date of Patent: Aug. 12, 1986

[54] METHOD AND APPARATUS FOR RETAINING ARTICLES ON PACKFRAMES

[76] Inventor: Steven E. Parker, 514 S. 119th St., Tacoma, Wash. 984442.

[21] Appl. No.: 697,788

[22] Filed: Feb. 4, 1985

[51] Int. Cl.[4] ..... A45F 3/04

[52] U.S. Cl. ..... 224/214; 224/153

[58] Field of Search ..... 224/202, 209, 153, 907, 224/270, 210, 262, 261, 211, 212, 214, 215, 263, 250

[56] References Cited

U.S. PATENT DOCUMENTS

| | | | |
|---|---|---|---|
| 37,203 | 12/1862 | Short | 224/250 X |
| 1,040,413 | 10/1912 | Renard . | |
| 1,296,619 | 3/1919 | Bulat | 224/907 X |
| 1,320,934 | 11/1919 | Schopp | 224/250 X |
| 1,969,199 | 8/1934 | Battles | 224/270 X |
| 2,139,309 | 12/1938 | Linden | 248/201 |
| 2,598,502 | 5/1952 | Butler | 248/201 X |
| 2,665,869 | 1/1954 | Samuels | 248/214 |
| 2,732,162 | 1/1956 | McKinley | 248/214 X |
| 3,648,907 | 3/1972 | Romney . | |
| 3,889,859 | 6/1975 | Joseph | 224/211 |
| 3,921,867 | 11/1975 | Farnbach | 224/262 |
| 3,923,217 | 12/1975 | Dean, II et al. . | |
| 4,087,031 | 5/1978 | Fenner . | |
| 4,194,656 | 3/1980 | Zufich | 224/211 |
| 4,361,259 | 11/1982 | Chanter . | |
| 4,431,121 | 2/1984 | Bensette | 224/153 |
| 4,489,866 | 12/1984 | Korte | 224/211 X |
| 4,518,107 | 5/1985 | Amos | 224/215 |

FOREIGN PATENT DOCUMENTS

| | | | |
|---|---|---|---|
| 208082 | 3/1909 | Fed. Rep. of Germany | 224/214 |
| 21000 | 4/1946 | Finland | 224/215 |
| 5138 | of 1879 | United Kingdom | 224/214 |

*Primary Examiner*—Stephen Marcus
*Assistant Examiner*—Robert Petrik
*Attorney, Agent, or Firm*—Keith D. Gehr

[57] ABSTRACT

The present invention is an article holding device for attaching external loads to a packframe. It consists of upper and lower clamp assemblies adapted for attachment to adjacent transverse packframe members. A rod, oriented vertically when the packframe is being worn, is held between the clamp assemblies. At least one, preferably two, strap retainers are mounted on the rod. These will normally have freedom of rotational and vertical movement. A strap or similar load retaining member passes through the slots of the retainers. Arranged thus, a load can be held tightly and securely against the packframe. In the preferred form of use, two of the assemblies are mounted side-by-side so that at least two straps may be placed around the external load.

17 Claims, 2 Drawing Figures

METHOD AND APPARATUS FOR RETAINING ARTICLES ON PACKFRAMES

BACKGROUND OF THE INVENTION

The present invention is a method and apparatus for retaining or holding external articles to packframes. The invention is particularly well adapted for retaining articles such as tents, sleeping bags, or other bulky or akwardly shaped articles which do not readily fit into a normal packsack.

Man has been carrying loads on his back since time immemorial. Quite probably he has been looking for ways to make this task easier and less unpleasant for the same period of time. In recent years, this method of transport has evolved from a necessity of life into the recreational activity known as backpacking. Backpacking today has become so popular that authorities are limiting access to certain areas in order to prevent ecological damage from heavy hiker traffic.

No small part of the current popularity of backpacking can be attributed to the availability of well designed, lightweight equipment. This includes items such as tents, stoves, sleeping bags, and other articles which are necessities for being comfortable and safe while hiking or camping in areas remote from vehicular transportation. A key item has been the development, largely subsequent to World War II, of ergonomically engineered lightweight packframes which support the load carrying packbag.

Ideally, the load center of a pack should be located as nearly as possible to the wearer's center of gravity, or on a line passing through the wearer's center of gravity. Packbags, or "knapsacks", were originally no more than a flexible bag having a pair of shoulder straps or a tumpline which was supported by the wearers forehead. These caused the wearer to bend forward while traveling in order to place the load more nearly in a line above the hips and legs. As the knapsack evolved it was attached to an external wooden framework, or occasionally had an internal metallic framework, so that the load center would lie closer to the back. Ultimately, the packframe was lengthened and a broad strap which rested on the top of the buttocks was added at the lower end. This development was effective in transferring a significant percentage of the load from the relatively weak back and shoulders to the much stronger pelvic and leg structure. At the same time a waist strap was often added to maintain the lower portion of the packframe in close contact with the body. A well designed and properly loaded packframe of this type can be carried with relatively little downward force on the shoulders and without the need for bending forward to balance the load.

There are abundant examples of packframes of the above type in the patent literature. The following U.S. Patents can be regarded as exemplary U.S. Pat. Nos.: Renard, 1,040,413; Romney, 3,648,907; Joseph, 3,889,859; Fenner, 4,087,031; and Chanter, 4,361,259. Dean, II et al., in U.S. Pat. No. 3,923,217 show a dual purpose tubular metal packframe which can be dismantled at a camp to serve as a tent framework.

Very often the demands of a particular trip will require the wearer to carry relatively large loads. In extreme circumstances these may be as high as 35 to 50 kg. Seldom can a load of this magnitude be retained within the packbag normally supplied with a packframe. Most hikers carry heavy loads prefer to mount a U-shaped extension bar to the upper part of the packframe where bulky articles can be tied. A hiker normally tries to pack the heaviest articles as high as possible and as close to the back as possible. Bulky light weight articles, such as a sleeping bag, are normally carried below the packbag. The extended portion of the frame above the packbag is an ideal place for loading the heavier articles. Unfortunately, little thought has been given as to how they are to be retained. In the past this has been done by tying them or strapping them, usually to the U-shaped extension or to any other portion of the packframe that is available. Most hikers who have had to resort to this sytem have had the experience of arriving in camp only to discover that some critical item has fallen off along the way because it was not securely fastened. Romney and Joseph note the problem of carrying loads external to the packbag, but they do not provide any new solutions. Chanter's packframe is made of welded wire, and he notes that a perimeter slot "provides an enormous number of connecting points to the frame for straps", and that "miscellaneous items can easily be lashed to the frame at any point by means of straps, laces, or strings". Romney provides a packframe with a number of smaller bags or containers which can be tied on or removed independently at various positions on the frame. The packframe itself has a plurality of transversely extending knob-like members which provide anchors for lashing the pack units. The vertical frame members terminate in slotted plugs which also act as lashing points.

The Romney system is especially designed to use light weight cordage to secure edge grommetted pack units. However, where cordage is used for lashing other external loads which are often of awkward shape, it is inherently poor because of the small bearing area exerted against the object. Straps are generally superior. Unfortunately, solid anchor points for straps are often awkwardly placed or are not available at all in the location needed.

The present invention has overcome the above problems and is a significant step forward as a means of holding and retaining objects to a packframe external to the main packbag.

SUMMARY OF THE INVENTION

The present invention is a method and a device for holding articles to a packframe. A packframe will normally have longitudinal packbag supporting members which are rigidly united by generally parallel, spaced apart, transverse cross bracing members. The present invention comprises first and second clamps, each of which is adapted for attachment to one of the transverse frame members. Each clamp is adapted to secure one end of a rod which is rigidly held between them. Mounted on the rod is at least one slotted strap retainer. This retainer is swivelable around the rod and may have freedom of movement along the rod. Preferably two strap retainers are positioned on the rod in a spaced apart relationship. A separate spacing means, which may be a tubular member mounted coaxially on the rod, can be used between the strap retainers to define a minimum separation between them. A strap passed through the slots of the strap retainers completes the assembly. The strap is adapted to firmly but releasably hold an external article to the packframe. The term strap should be construed sufficiently broadly to include cordage. The preferred form is one in which the term "strap" is used in its more normal context; i.e., having a width greatly in excess of the thickness.

In the most preferred form of the invention two such units will be used in a side-by-side spaced apart relationship, mounted on the same transverse bracing members of the packframe.

The clamps themselves can be any of a number of well known types. The most preferred types are loop clamps, sometimes called P-clamps, which are modified to have an integral or separately attached body portion or anchor block adapted to retain the end of the rod. These can be readily bolted or otherwise secured to the frame members.

It is an object of the present invention to provide an article holding device for a packframe which will firmly and reliably hold an article to be attached to the packframe external to a conventional packbag.

It is another object to provide a method of attaching external articles to a packframe.

It is a further object to provide an article holding device for a packframe which can be inexpensively manufactured and readily installed or removed, using only simple tools.

These and many other objects will become readily apparent to those skilled in the art upon reading the following detailed description taken in conjunction with the drawings.

DETAILED DESCRIPTION OF THE PREFERRED EMBODIMENTS

Figure 1:
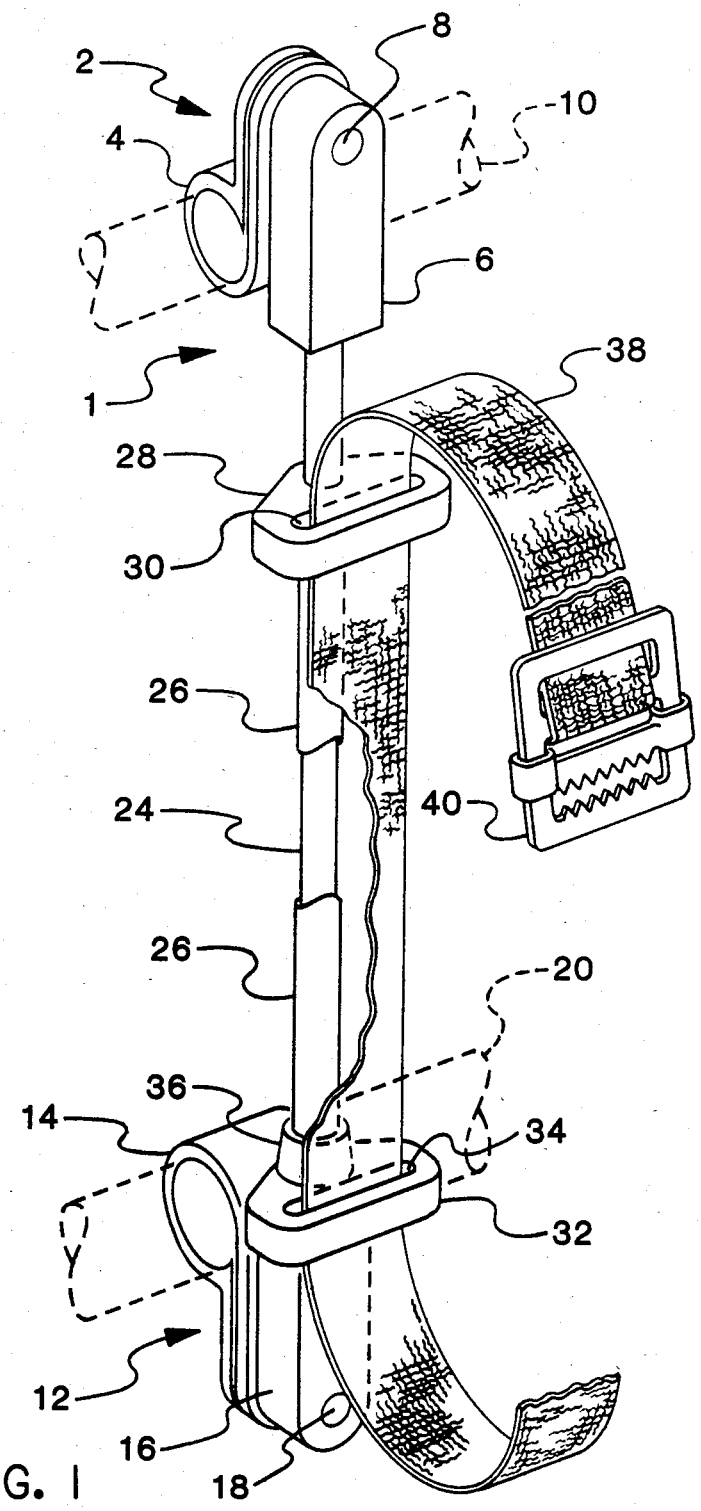
FIG. 1 is a perspective view of the article-holding device or retainer.

Construction of the article retaining or holding device can be readily understood by referring to FIG. 1. The device 1 comprises a first clamp assembly 2 and a second clamp assembly 12. The first clamp assembly consists of a loop or P-clamp 4 and an anchor block or body portion 6, which is joined to the loop clamp by a removable fastener 8. Here the clamp assembly is shown in place on a packframe cross member 10. The second clamp assembly has a similar or identical loop or P-clamp 14 to which anchor block 16 is united by fastener 18. This second or lower clamp assembly is shown mounted on a second packframe cross member 20. A rod 24 is held between anchor blocks 6 and 16. The loop clamps and anchor blocks can be made of any suitable material, preferably a molded thermoplastic resin.

Fasteners 8 and 18 will typically be a flush-type bolt and nut arrangement so that the device can be readily installed on a packframe, with no more than a screwdriver being required. Rod 24 can be sized to length for the particular installation. Some adjustability is achieved by allowing this rod to telescope within anchor block 6. In order to ensure easy installation, the clamps can be slid along and rotated about the packframe cross members. Some rotation of the anchor blocks is also permitted around fasteners 8, 18.

At least one strap retainer, preferably two, are mounted on rod 24. As shown here, an upper strap retainer 28, having a strap slot 30, is shown mounted on rod 24. Similarly, a lower strap retainer 32, having slot 34, is mounted on rod 24 in complementary fashion. The strap retainers may advantageously include a boss or buttressed portion 36 to give added strength. Both of the strap retainers are free to have vertical and rotational movement around rod 24. Optionally, a spacer tube 26, here shown partially cut away, may be used between the strap retainers. Articles are held by a webbing strap 38, terminated with a buckle or other fastening means 40.

Figure 2:
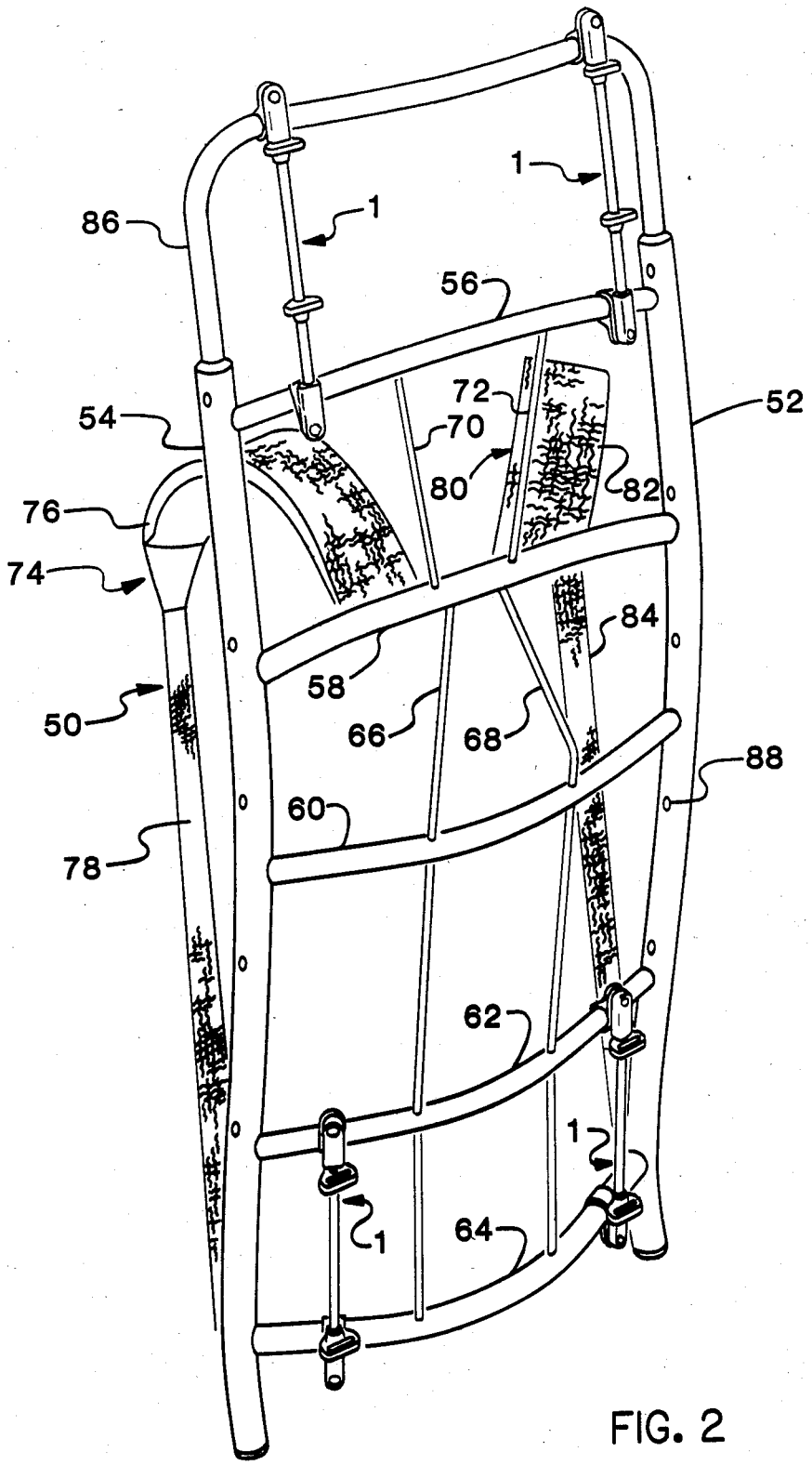
FIG. 2 is a perspective view of a pack frame on which four of the article retainers have been mounted.

FIG. 2 shows four of the holding devices mounted on a packframe, generally indicated at 50. The packframe consists of upright members 52, 54 and welded or otherwise affixed cross braces 56, 58, 60, 62, 64. Strain or stabilizing rods 66, 68, 70, 72 give added strength to the unit without contributing significant weight. Straps 74, 80 are adapted to pass around a wearers shoulders. These consist of an upper padded portion 76, 82, anchored to transverse brace 58, and a lower webbing portion 78, 84 attached at the lower ends of the upright frame members. Mounted at the top of the packframe is an extension bar 86, which in many cases is optional for the user.

A packbag may be attached to the frame by a number of well known means. One of the most common is the use of clevis pins mounted through apertures 88, only one of which is numbered. These are drilled through upright members 52, 54. In the present illustration a packbag would normally occupy the space between cross braces 56 and 62. In typical usage, a sleeping bag would be strapped or tied in the area between cross braces 62 and 64.

Four of the article holding devices 1 of the present invention are shown mounted on the packframe, two at the top and two at the bottom. Those at the top, mounted between cross brace 56 and extension bar 86 would be used to secure a top load which could be a tent or any other bulky item which could not be conveniently stored within the packbag. This can be securely fastened by the straps 38, which are not shown in FIG. 2 for sake of clarity of illustration. The lower article holding devices, mounted between cross braces 62, 64, could be used to securely attach a sleeping bag or any other bulky item.

In some cases a single article-holding device mounted on a packframe would be useful to accomplish the desired purpose. However, it is preferred that they be used in side-by-side pairs for the sake of convenience and for more safely securing articles external to the packbag. Similarly, a singe strap retainer can be used on rods 24, but the invention is more effective when these are used in pairs.

Having disclosed the best mode known to the inventor of making and using the present invention, it will be evident to those skilled in the art that many variations are possible without departing from the spirit of the invention. The scope of the invention is considered to be limited only as defined in the following claims.

What is claimed is:

1. A device for attaching an ancillary article to a packframe which comprises:

a. first and second clamp means adapted for attachment to rigid, spaced apart, generally parallel packframe members;

b. rod means held between the clamp means;

c. at least one slotted strap retaining means swivelably mounted on the rod means and having at least limited freedom of movement along the rod means; and d. strap means passing through the slots of the strap retaining means, said strap means being adapted to firmly but releasably hold an ancillary article to be attached to the packframe.

2. The article holding device of claim 1 which has two spaced apart strap retaining means.

3. The article holding device of claim 2 which has spacing means mounted on the rod means to define a minimum separation between the strap retaining means.

4. The article holding device of claim 3 in which the spacing means is a tubular member mounted coaxially on the rod means between the strap retaining means.

5. The article holding device of claim 1 in which the clamp means are loop clamps having an attached body portion adapted to retain the rod means.

6. The article holding device of claim 1 further in combination with a packframe.

7. A packframe having longitudinal packbag supporting members and generally parallel transverse bracing members, said packframe having in combination an ancillary article holding device comprising:

a. first and second clamp means, each being attached to one of the spaced apart transverse bracing members;

b. rod means held between the clamp means;

c. at least one slotted strap retaining means swivelably mounted on the rod means and having at least limited freedom of movement along the rod means; and d. strap means passing through the slots of the strap retaining means, said strap means being adapted to firmly but releasably hold an ancillary article to be attached to the packframe.

8. The packframe of claim 7 having two side-by-side spaced apart article retaining devices.

9. The packframe of claim 8 in which each retaining device has two strap retaining means.

10. The packframe of claim 9 which has spacing means mounted on the rod means to define a minimum separation between the strap retaining means.

11. The packframe of claim 10 in which the spacing means is a tubular member mounted coaxially on the rod means between the strap retaining means.

12. The packframe of claim 7 in which te clamp means are loop clamps having an attached body portion adapted to retain the rod means.

13. A method for holding ancillary articles on a packframe having longitudinal packbag supporting members and generally parallel transverse bracing members, which comprises:

a. providing first and second clamp means adapted for attachment to spaced apart transverse bracing members;

b. holding a rod means between the clamp means;

c. swivelably mounting at least one slotted strap retaining means on the rod means so as to have at least limited freedom of movement along the rod means; and d. passing strap means through the slots of the strap retaing means, said strap means being adapted to firmly but releasably hold an ancillary article to be attached to the packframe.

14. The method of claim 13 in which the packframe has two side-by-side spaced apart article retaining devices.

15. The method of claim 14 in which each retaining device has two strap retaining means.

16. The method of claim 15 which has spacing means mounted on the rod means to define a minimum separation between the strap retaining means.

17. The method of claim 13 in which the clamp means are loop clamps having an attached body portion adapted to retain the rod means.

* * * * *